US011260355B2

(12) United States Patent
King et al.

(10) Patent No.: US 11,260,355 B2
(45) Date of Patent: Mar. 1, 2022

(54) APPARATUS FOR MAKING CONTENT LIQUID FOAMY FOR DISCHARGE AND SYSTEMS AND METHODS THEREOF

(71) Applicant: KAO CORPORATION, Tokyo (JP)

(72) Inventors: Chris King, Cincinnati, OH (US); Ryohei Aoyama, Soka (JP); Noboru Yashima, Tokyo (JP)

(73) Assignee: KAO CORPORATION, Tokyo (JP)

( * ) Notice: Subject to any disclaimer, the term of this patent is extended or adjusted under 35 U.S.C. 154(b) by 237 days.

(21) Appl. No.: 16/160,335

(22) Filed: Oct. 15, 2018

(65) Prior Publication Data

US 2019/0111400 A1 Apr. 18, 2019

Related U.S. Application Data

(60) Provisional application No. 62/573,348, filed on Oct. 17, 2017.

(51) Int. Cl.
*B01F 3/04* (2006.01)
*B01F 23/235* (2022.01)
(Continued)

(52) U.S. Cl.
CPC ..... *B01F 23/235* (2022.01); *B01F 25/3111* (2022.01); *B01F 25/31112* (2022.01);
(Continued)

(58) Field of Classification Search
CPC .. B01F 3/04446; B01F 5/0406; B01F 5/0408; B01F 5/0465; B01F 5/0685;
(Continued)

(56) References Cited

U.S. PATENT DOCUMENTS 3,709,437 A 1/1973 Wright
4,615,467 A 10/1986 Grogan et al.
(Continued)

FOREIGN PATENT DOCUMENTS

CN 1297382 A 5/2001
CN 1356952 A 7/2002
(Continued)

OTHER PUBLICATIONS

International Search Report and Written Opinion dated Dec. 11, 2018 in PCT/US2018/055901.

*Primary Examiner* — Charles S Bushey
(74) *Attorney, Agent, or Firm* — Oblon, McClelland, Maier & Neustadt, L.L.P.

(57) ABSTRACT

Systems, apparatuses, and methods for making content liquid foamy for discharge are described herein. A dispenser for making content liquid discharge foamy by mixing air flow from an air chamber with the content liquid flow from a liquid chamber can be provided. The dispenser can include a mixing chamber configured to mix air and content liquid; a porous member between an air passage from the air chamber and the mixing chamber; and a liquid passage from the liquid chamber to the mixing chamber. The liquid passage can have a first liquid passage and a plurality of second liquid passages. The liquid passage can be configured such that content liquid flows from the first liquid passage to the second liquid passages to the mixing chamber. The second liquid passages can be configured to provide flow of the content liquid in at least two directions.

20 Claims, 7 Drawing Sheets

(51) Int. Cl.

| | |
|---|---|
| ***B01F 25/31*** | (2022.01) |
| ***B01F 25/451*** | (2022.01) |
| ***B01F 25/452*** | (2022.01) |
| ***B01F 25/313*** | (2022.01) |
| ***B01F 35/75*** | (2022.01) |

(52) U.S. Cl.
CPC .. *B01F 25/313311* (2022.01); *B01F 25/4512* (2022.01); *B01F 25/4522* (2022.01); *B01F 35/7546* (2022.01); *B01F 35/75425* (2022.01)

(58) Field of Classification Search
CPC .. B01F 5/0691; B01F 15/0278; B01F 15/029; B01F 23/235; B01F 2/3111; B01F 25/31112; B01F 25/313311; B01F 25/4512; B01F 25/4522; B01F 35/75425; B01F 35/7546
USPC ..... 261/34.1, 95, 101, DIG. 26, DIG. 75
See application file for complete search history.

(56) References Cited

U.S. PATENT DOCUMENTS

| | | | |
|---|---|---|---|
| 4,901,925 | A | 2/1990 | Blake, III |
| 4,991,779 | A | 2/1991 | Blake, III |
| 5,238,155 | A | 8/1993 | Blake, III |
| 5,725,129 | A | 3/1998 | Chapin et al. |
| 6,547,162 | B1 | 4/2003 | De Regt et al. |
| 8,002,151 | B2 | 8/2011 | Matthews et al. |
| 8,281,958 | B2 | 10/2012 | Matthews et al. |
| 10,765,590 | B2 * | 9/2020 | Lee ..... B05B 11/3087 |
| 10,779,690 | B2 * | 9/2020 | Aoyama ..... B65D 47/06 |
| 2002/0056730 | A1 | 5/2002 | Van de Heijden |
| 2007/0278247 | A1 | 12/2007 | Banks et al. |
| 2009/0206109 | A1 | 8/2009 | Santagiuliana |
| 2009/0236371 | A1 | 9/2009 | Van Der Heijden |
| 2013/0048755 | A1 * | 2/2013 | Uehira ..... B05B 11/3087 239/318 |
| 2015/0342421 | A1 * | 12/2015 | Harris ..... B05B 11/3097 222/190 |
| 2018/0326434 | A1 * | 11/2018 | Aoyama ..... B05B 11/306 |
| 2019/0125137 | A1 * | 5/2019 | Takagi ..... A47K 5/12 |
| 2020/0085669 | A1 | 3/2020 | Lee |

FOREIGN PATENT DOCUMENTS

| | | | |
|---|---|---|---|
| JP | 52-45718 | A | 4/1977 |
| JP | 3-47029 | U | 4/1991 |
| JP | 3-85979 | U | 8/1991 |
| JP | 10-137153 | A | 5/1998 |
| JP | 2002-78628 | A | 3/2002 |
| JP | 2005-263324 | A | 9/2005 |
| JP | 2007-14506 | A | 1/2007 |
| JP | 2012-139512 | A | 7/2012 |
| JP | 2016-73528 | A | 5/2016 |
| KR | 101701773 | B1 | 2/2017 |
| TW | 201739512 | A | 11/2017 |
| WO | WO 2018/003375 | A1 | 1/2018 |

* cited by examiner

APPARATUS FOR MAKING CONTENT LIQUID FOAMY FOR DISCHARGE AND SYSTEMS AND METHODS THEREOF

CROSS REFERENCE TO RELATED APPLICATION

This application claims the benefit and priority of U.S. Provisional Patent Application No. 62/573,348, filed Oct. 17, 2017, the entire content and disclosure of which is incorporated by reference into the present application.

FIELD

Embodiments of the disclosed subject matter are directed generally to foaming dispensers, and more particularly to systems, apparatuses, and methods for making content liquid foamy for discharge.

SUMMARY

According to one or more embodiments of the present disclosure, a foaming dispenser for making content liquid discharge foamy by mixing air flow from an air chamber with content liquid flow from a liquid chamber is provided. The foaming dispenser can comprise: a mixing chamber configured to mix air and content liquid; a porous member between an air passage from the air chamber and the mixing chamber; and a liquid passage from the liquid chamber to the mixing chamber. The liquid passage has a first liquid passage and a plurality of second liquid passages. The liquid passage is configured such that content liquid flows from the first liquid passage to the second liquid passages to the mixing chamber. The second liquid passages are configured to provide flow of the content liquid in at least two directions.

Also, in one or more embodiments, a foamer assembly is provided. The foamer assembly can comprise: a container body configured to hold at least the content liquid; and a foaming dispenser for making content liquid discharge foamy by mixing air flow from an air chamber with the content liquid flow from a liquid chamber. The foaming dispenser can comprise: a mixing chamber configured to mix air and content liquid; a porous member between an air passage from the air chamber and the mixing chamber; and a liquid passage from the liquid chamber to the mixing chamber. The liquid passage has a first liquid passage and a plurality of second liquid passages. The liquid passage is configured such that content liquid flows from the first liquid passage to the second liquid passages to the mixing chamber. The second liquid passages are configured to allow flow of the content liquid in at least two directions.

Embodiments also include a dispenser to make content liquid foamy comprising: means making the content liquid foamy by mixing air and content liquid; means for allowing the air to pass to the means for mixing; and means for providing the content liquid to the means for mixing.

Embodiments can also include methods of providing, making, and/or using foaming dispenser, a foamer assembly, or a dispenser according to embodiments of the disclosed subject matter.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figures 1A, 1B:
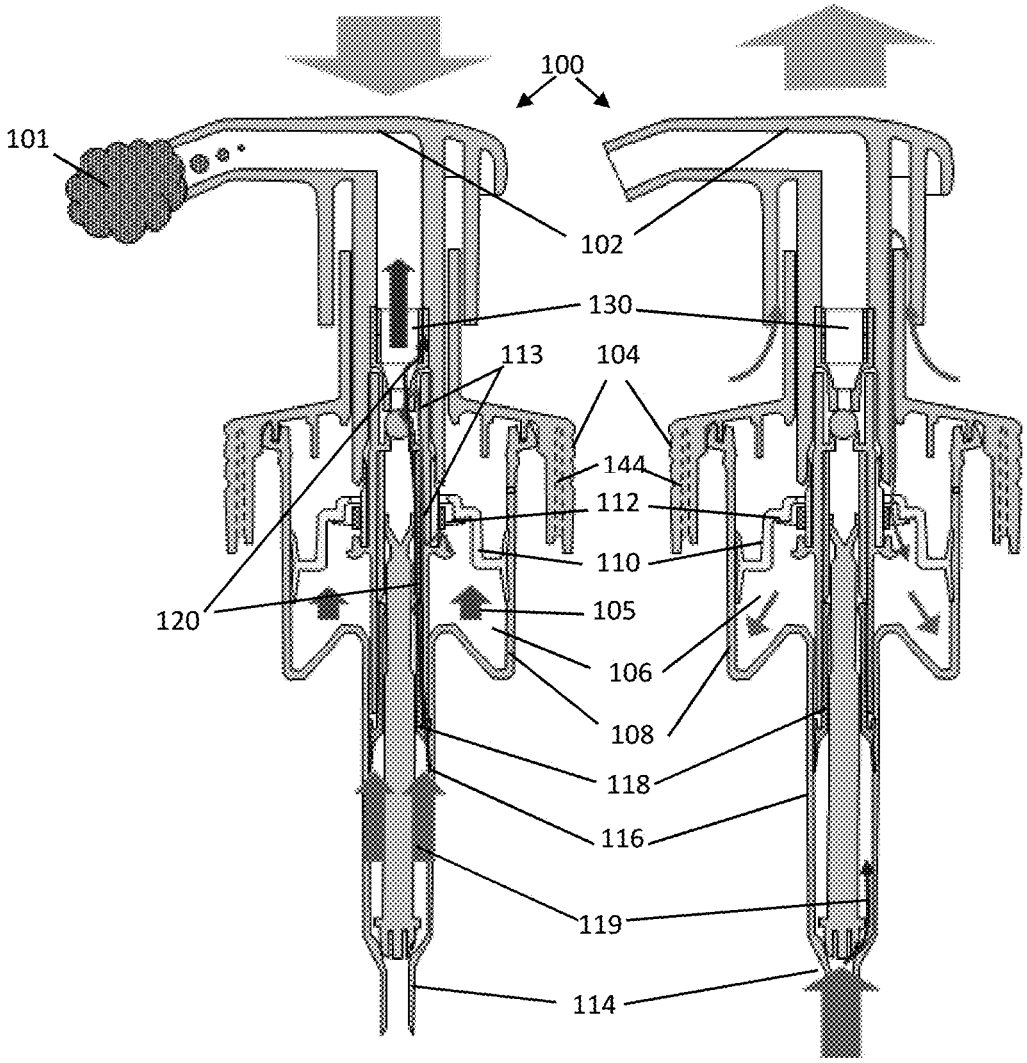
FIGS. 1A and 1B each show a sectional view of a portion of a pump foamer assembly according to one or more embodiments of the disclosed subject matter.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Embodiments of the disclosed subject matter are directed generally to systems, apparatuses, and methods for making foamy for discharge content liquid, such as liquid soap, liquid detergent, liquid cosmetic composition, liquid hair composition, or liquid skin care compositions, such as lotions, creams, or emulsions. Embodiments can thus include foaming dispensers or foaming assemblies comprised of foaming dispensers.

Embodiments of the disclosed subject matter may produce gritty or high-viscosity foam at low pressure. Thus, the content liquid may include one or more additives including powder, particles, and/or abrasives, such as solid polymer particles, waxes, ultraviolet scattering agents, solid oil particles, silica, or organic matter. Optionally, the additive(s) can be provided to the content liquid before reaching a mixing chamber. Size of one, some, or all of the powder, particles, or abrasives may be from 0.001 μm to 1000 μm, preferably from 0.1 μm to 700 μm, more preferably from 0.5 μm to 500 μm. Size can be particle diameter, which may mean the radius of a sphere, generally speaking. Powder or particle size can be obtained by measuring a distribution of the powder or particles using a laser diffraction scattering method, for instance, using a Model LA-920 from Horiba, Ltd. Additionally or alternatively, viscosity of the content liquid, at 25° C., for instance, may be from about 10 centipoise to about 20000 centipoise, preferably from about 20 centipoise to about 10000 centipoise, more preferably from about 30 centipoise to about 2000 centipoise, in embodiments of the disclosed subject matter. Further, embodiments of the disclosed subject matter may reduce or prevent clogging of scrub matter, at least prior to reaching a mixing chamber, for instance. The viscosity (e.g., at 25° C.) can be measured by a B-type viscometer, 1 rpm (rotational speed), for instance. The type of rotor and rotational speed can be selected based on a model of viscometer and viscosity level.

Generally speaking, embodiments of the disclosed subject matter can provide plural liquid flow passages and separate air passage(s) so content liquid and air can first meet or come into contact with each other in the mixing chamber so as to make the content liquid foamy for discharge. The blend ratio of the air and the liquid (air/liquid) by volume ratio may be about 10~40.

For example, embodiments of the disclosed subject matter can involve, generally speaking, a dispenser for making content liquid discharge foamy by mixing air flow from an air chamber with the content liquid flow from a liquid chamber is provided. The foaming dispenser can be comprised of a mixing chamber configured to mix air and content liquid; a porous member between an air passage from the air chamber and the mixing chamber; and a liquid passage from the liquid chamber to the mixing chamber. The liquid passage can have a first liquid passage and a plurality of second liquid passages. The liquid passage may be configured such that content liquid flows from the first liquid passage to the second liquid passages to the mixing chamber. The second liquid passages can be configured to allow or provide flow of the content liquid to the mixing chamber in at least two directions. Optionally, the second liquid passages can enter the mixing chamber relatively close to an output side of the porous member that may define the output of the air passage. Optionally, the liquid passage may have one or more liquid passages between the first liquid passage and the second liquid passages.

In one or more embodiments, a dispenser may be comprised of a fixing member (e.g., a brace) configured to fix or retain the porous member. The fixing member can be provided at a downstream side of the porous member. The fixing member can be fixed to or held against the porous member by air pressure, for instance. The fixing member can prevent or reduce movement of the porous member downstream due to air pressure. Further, the second liquid passages can be provided below and/or inside the fixing member. That is, the fixing member can form some or all of the second liquid passages. Preferably, the fixing member may have concave portions in part and can form the second flow passages between the concave portions and the porous member. The fixing member may be fit into a hollow body of the foaming dispenser that defines at least a portion of the mixing chamber.

Embodiments of the disclosed subject matter may involve pump-type foamers and squeeze-type foamers. Generally, a pump-type foamer can have an air chamber and a separate liquid chamber and can operate to discharge foamy content liquid via operation of a mechanical pump. Generally, a squeeze-type foamer can have a shared air and liquid chamber and can operate to discharge foamy content liquid via a squeezing operation to the shared air and liquid chamber.

Turning now to the figures, FIGS. 1A and 1B each show a sectional view of a portion of a pump foamer assembly 100 according to one or more embodiments of the disclosed subject matter.

The pump foamer assembly 100 can be a pump-type foamer assembly and can be comprised of a cap discharge head 102, a cap neck 104, an air chamber 106, an air cylinder 108, an air piston 110, an air valve 112, a stem 114 to a liquid chamber of a liquid container (both not expressly shown), a liquid cylinder 116, and a liquid piston 118. The pump foamer assembly 100 can also include a foaming dispenser according to embodiments of the disclosed subject matter, which is not expressly illustrated in FIGS. 1A and 1B, but can be provided in the foaming area 130. The pump foamer assembly 100 can also include the liquid container to hold content liquid, such as liquid soap, and the liquid container can be removably coupled via a container neck 144 to the cap neck 104.

As illustrated generally by FIGS. 1A and 1B, the pump foamer assembly 100 can implement the air chamber 106, the air cylinder 108, the air piston 110, and the air valve 112 to operate as a mechanical pump responsive to downward and upward movement of the cap discharge head 102 to cause air 105 in the air chamber 106 to be transported to the foaming area 130 via air flow path 113 and discharged via cap discharge head 102. Likewise, the pump foamer assembly 100 can implement the stem 114, the liquid cylinder 116, and the liquid piston 118 to operate as a mechanical pump responsive to downward and upward movement of the cap discharge head 102 to cause content liquid 119 in the liquid container to move through the stem 114 and be transported to the foaming area 130 via liquid flow path 120. As can be seen from FIG. 1A, the air flow path 113 and the liquid flow path do not meet until reaching the foaming area 130, particularly a mixing chamber, which will be discussed in more detail below.

As used herein, the cap discharge head 102 may be referred to as a pressing part. Thus, generally speaking, when the cap discharge head 102 is pressed down, for example by way of a user's hand, an amount of foamy content liquid can be discharged from the cap discharge head 102, and when the cap discharge head 102 is allowed to rise, air 105 can be provided to the air chamber 106 and content liquid 119 can be provided to the liquid cylinder 116. Based on the configuration of the cap discharge head 102, the flow of the foamy content liquid 101 from the mixing chamber to a discharge opening of the cap discharge head 102 can proceed vertically then horizontally to reach the discharge opening.

Figure 2A:
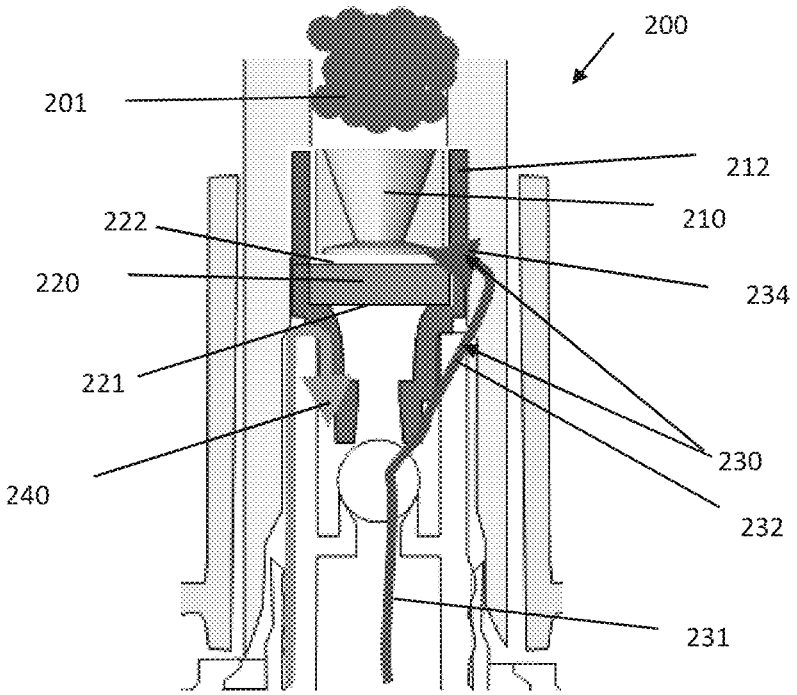
FIG. 2A is a diagrammatic rendering of a foaming dispenser according to one or more embodiments of the disclosed subject matter.
Figure 2B:
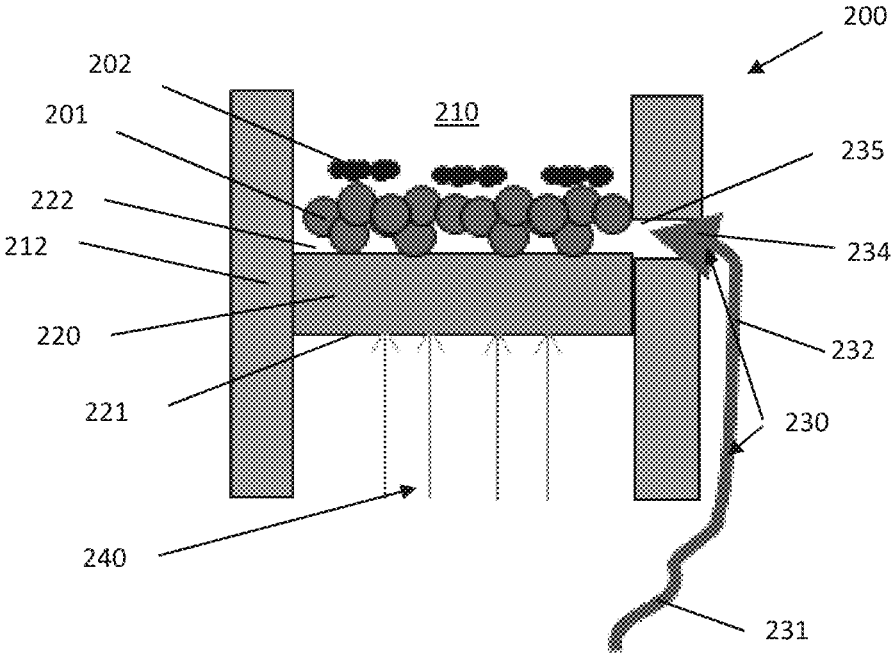
FIG. 2B is an enlarged portion of the foaming dispenser of FIG. 2A.

FIG. 2A is a diagrammatic rendering of a foaming dispenser 200 according to one or more embodiments of the disclosed subject matter, and FIG. 2B is an enlarged portion of the foaming dispenser 200 of FIG. 2A.

Foaming dispenser 200 can include a mixing chamber 210, a porous member 220, and a liquid passage 230. The mixing chamber 210 may be formed at least by a mixing chamber body 212 and a surface of the porous member 220 at an output 222 of the porous member 220.

Generally speaking, foaming dispenser 200 may be referred to as an air-through foaming dispenser, meaning that air 240 is passed to an input 221 of the porous member 220, through the porous member 220, and output from the output 222 of the porous member 220 so as to enter the mixing chamber 210. Further, foaming dispenser 200 can make content liquid discharge foamy by mixing air 240 with the content liquid 231 to create foamy content liquid 201. Optionally, as diagrammatically illustrated in FIG. 2B, the foamy content liquid 201 can include or be provided with scrub matter 202, such as one or more of powder, particles, or abrasives. The air 240 can be provided from an air chamber (not expressly shown), and the content liquid 231 can be provided from a liquid chamber (not expressly shown).

The liquid passage 230 may be comprised of a first liquid passage 232 and one or a plurality of second liquid passages 234. In this regard, FIGS. 2A and 2B show only one second liquid passage 234; however, embodiments of the disclosed subject matter are not limited to a single second liquid passage 234, and preferably can have a plurality of second liquid passages 234, and even more preferably can have four second liquid passages 234. In the case of multiple second liquid passages 234, the second liquid passages 234 can be configured to allow or provide flow of the content liquid 231 in at least two directions. Each second liquid passage 234 may lead to the mixing chamber 210 via an opening 235, which may be formed in the mixing chamber body 212. The openings 235 can be provided at the output 222 of the porous member 220, for instance, adjacent to output 222 of the porous member 220.

Optionally, in one or more embodiments, the second liquid passages 234 can include at least one pair of second liquid passages 234 that output content liquid 231 in opposite directions, and preferably two pairs of second liquid passages 234 that output content liquid 231 in respective opposite directions.

The first liquid passage 232 can intersect the second liquid passages 234. For example, an end portion of the first liquid passage 232 can be adjacent to a first end portion of each second liquid passages 234, and a second end portion of the second liquid passages 234 opposite the first end portion can be in direction fluid communication with the mixing chamber 210. Thus, a first direction at which the air is provided from the porous member 220 to the mixing chamber 210 may intersect a second direction at which the content liquid 231 is output from each of the second liquid passages 234 to the mixing chamber 210.

The porous member 220 can be configured to allow air to pass and to prevent the content liquid 231 from passing (from the output 222 of the porous member 220, since the content liquid 231 does not contact the input 221 of the porous member 220). Thus, the porous member 220 can receive air 240 at the input 221 of the porous member 220, allow the air to pass therethrough, and output the air from the output 222 of the porous member 220 to the mixing chamber 210. Optionally, the porous member 220 can have an average pore size of from about 20 μm to about 100 μm. The porous member 220 can be formed of a porous material including mesh, gauze, foam, sponge or a combination of two or more of mesh, gauze, foam, or sponge. Further, the porous member 220 can be arranged above the first liquid passage and below the mixing chamber 210, and the porous member 220 may be in the form of a flat plate, a flat ring, or a flat disc, for instance. Optionally, the porous member 220 may be fixedly or removably provided relative to the mixing chamber 210.

Air may be output from the output 222 of the porous member 220 so as to intersect the content liquid 231 output from the second liquid passages 234 to the mixing chamber 210. Such intersecting can create the foamy content liquid 201. Further, as noted above, the content liquid 231 and the air 240 may first enter or first be provided to the mixing chamber 210 at a same time. Put another way, the air 240 and the content liquid 231 may first come into contact with each other in the mixing chamber 210. Further, the content liquid 231 can bypass the input 221 of the porous member 220, or, said differently, can reach the mixing chamber 210 without going through the porous member 220.

Figure 3:
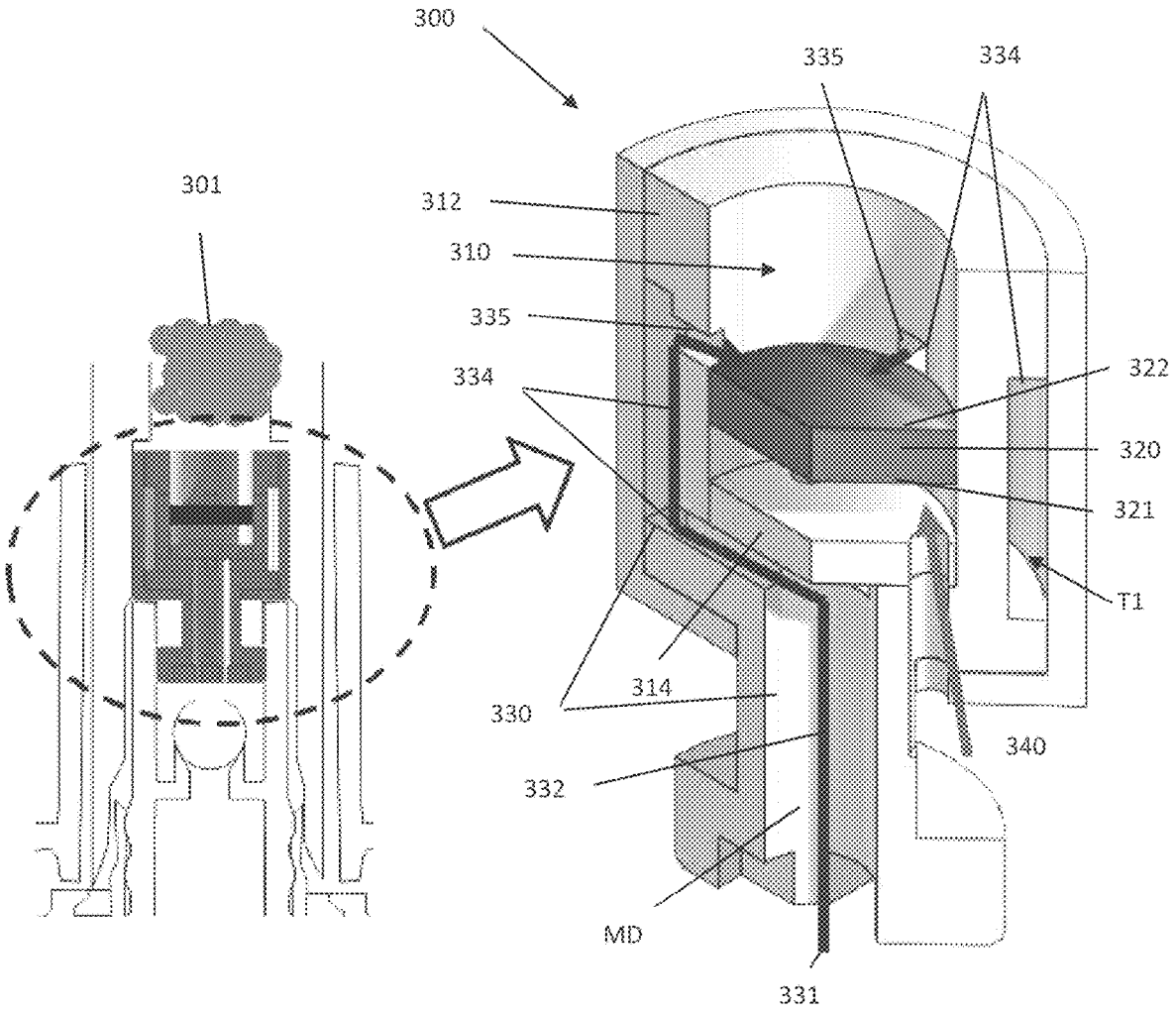
FIG. 3 is a sectional view of a foaming dispenser according to one or more embodiments of the disclosed subject matter.

FIG. 3 is a sectional view of a foaming dispenser 300 according to an embodiment of the disclosed subject matter.

Foaming dispenser 300 can include a mixing chamber 310, a porous member 320, and a liquid passage 330. The mixing chamber 310 may be formed at least by a mixing chamber body 312 and a surface of the porous member 320 at an output 322 of the porous member 320. Generally, the foaming dispenser 300 may be referred to as an air-through foaming dispenser, meaning that air 340 is passed to an input 321 of the porous member 320, through the porous member 320, and output from the output 322 of the porous member 320 so as to enter the mixing chamber 310. The air 340 may also be passed through an air interface 314 through one or more openings. Further, foaming dispenser 300 can make content liquid 331 foamy by mixing air output from the porous member 320 with the content liquid 331 to create foamy content liquid 301. Though FIG. 3 shows a sectional view, note that the air 340 and the content liquid 331 do not mix until they each reach the mixing chamber 310.

The liquid passage 330 can be comprised of a first liquid passage 332 and a plurality of second liquid passages 334. In particular, FIG. 3 shows two second liquid passages 334, though since FIG. 3 represents a sectional view, the foaming dispenser 300 can have four second liquid passages 334, for instance, each with a corresponding opening 335 that leads into the mixing chamber 310. Thus, the second liquid passages 334 can provide or allow flow of the content liquid 331 into the mixing chamber 310 in at least two directions, for example, four directions of flow. Optionally, opposing pairs of second liquid passages 334 can output content liquid 331 in respective opposite directions, in this example, inward, radially inward, for instance. Further, each of the openings 335 can be provided at the output 322 of the porous member 320, for instance, adjacent the output 322 of the porous member 320. Optionally, the air 340 can be provided to the mixing chamber 310 at the output 322 of the porous member 320, inward of the respective openings 335 of the second liquid passages 334. In one or more embodiments, optionally, each of the second liquid passages 334 can have a portion (or portions) formed at a right angle with the first liquid passage 332.

Optionally, a sectional area orthogonal to each of the second liquid passages 334 can be smaller than a sectional area orthogonal to the first liquid passage 332. For example, portions of the second liquid passages 334 may have a thickness T1, which may be 0.9 mm, for instance, where the thickness T1 may also correspond to a thickness of the openings 335, and the first liquid passage 332 may have a maximum sectional dimension MD (e.g., diameter) of 2 mm, for instance. Alternatively, a total sectional area of all of the second liquid passages 334 may be less than a total sectional area orthogonal to the first liquid passage 332. Also, optionally, a total surface area of a surface of the porous member 320 at the output 322 of the porous member 320 can be greater than a total sectional area of respective openings 335 to the mixing chamber 310 of the second liquid passages 334.

Figure 4:
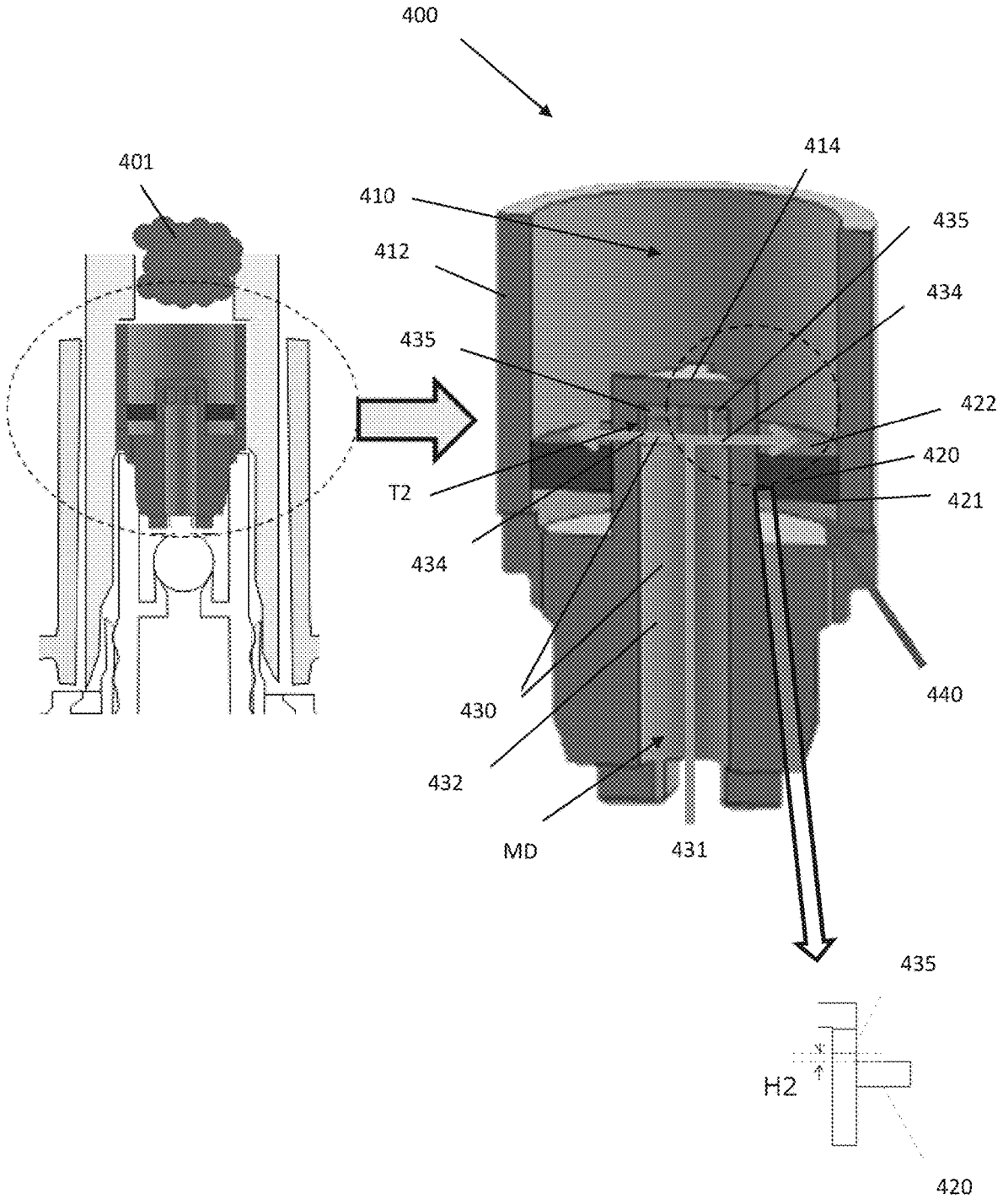
FIG. 4 is a sectional view of another foaming dispenser according to one or more embodiments of the disclosed subject matter.

FIG. 4 is a sectional view of a foaming dispenser 400 according to an embodiment of the disclosed subject matter.

Foaming dispenser 400 can include a mixing chamber 410, a porous member 420, and a liquid passage 430. The mixing chamber 410 may be formed at least by a mixing chamber body 412 and a surface of the porous member 420 at an output 422 of the porous member 420. Generally, the foaming dispenser 400 may be referred to as an air-through foaming dispenser, meaning that air 440 is passed to an input 421 of the porous member 420, through the porous member 420, and output from the output 422 of the porous member 420 so as to enter the mixing chamber 410. Further, foaming dispenser 400 can make content liquid 431 foamy by mixing air output from the porous member 420 with the content liquid 431 to create foamy content liquid 401. Though FIG. 4 shows a sectional view, note that the air 440 and the content liquid 431 do not mix until they each reach the mixing chamber 410.

The liquid passage 430 can be comprised of a first liquid passage 432 and a plurality of second liquid passages 434. In particular, FIG. 4 shows a central projection 414 that projects through an opening of the porous member 420 and into the mixing chamber 410. Thus, a portion of the central projection 414 that extends from the porous member 420 may form part of the mixing chamber 410. Further, the central projection 414 may be hollow and define the first liquid passage 432 and the second liquid passages 434. Also, the porous member 420 can be arranged radially outward of a portion of the first liquid passage 432, for instance, as defined by the central projection 414.

FIG. 4 shows two second liquid passages 434, though since FIG. 4 represents a sectional view, the foaming dispenser 400 can have four second liquid passages 434, for example, each with a corresponding opening 435 that leads into the mixing chamber 410. Thus, the second liquid passages 434 can provide or allow flow of the content liquid 431 in at least two directions into the mixing chamber 410, for example, four directions of flow. Optionally, opposing pairs of second liquid passages 434 can output content liquid 431 in respective opposite directions, in this example, outward, radially outward, for instance. Also, the air 440 can be provided to the mixing chamber 410 at the output 422 of the porous member 420 radially outward of the openings 435 of the second liquid passages 434.

Further, each of the openings 435 can be provided at the output 422 of the porous member 420, for instance, adjacent the output 422 of the porous member 420. Alternatively, each of the openings 435 may be offset by an offset height H2 from the output 422 of the porous member 420. In one or more embodiments, optionally, each of the second liquid passages 434 can have a portion (or portions) formed at a right angle with the first liquid passage 432.

Optionally, a sectional area orthogonal to each of the second liquid passages 434 can be smaller than a sectional area orthogonal to the first liquid passage 432. For example, portions of the second liquid passages 434, such as openings 435, may have a thickness T2, which may be 1 mm, for instance, and the first liquid passage 432 may have a maximum sectional dimension MD (e.g., diameter) of 2 mm, for instance. Alternatively, a total sectional area of all of the second liquid passages 434 may be less than a total sectional area orthogonal to the first liquid passage 432. Also, optionally, a total surface area of a surface of the porous member 420 at the output 422 of the porous member 420 can be greater than a total sectional area of respective openings 435 to the mixing chamber 410 of the second liquid passages 434.

Figure 5:
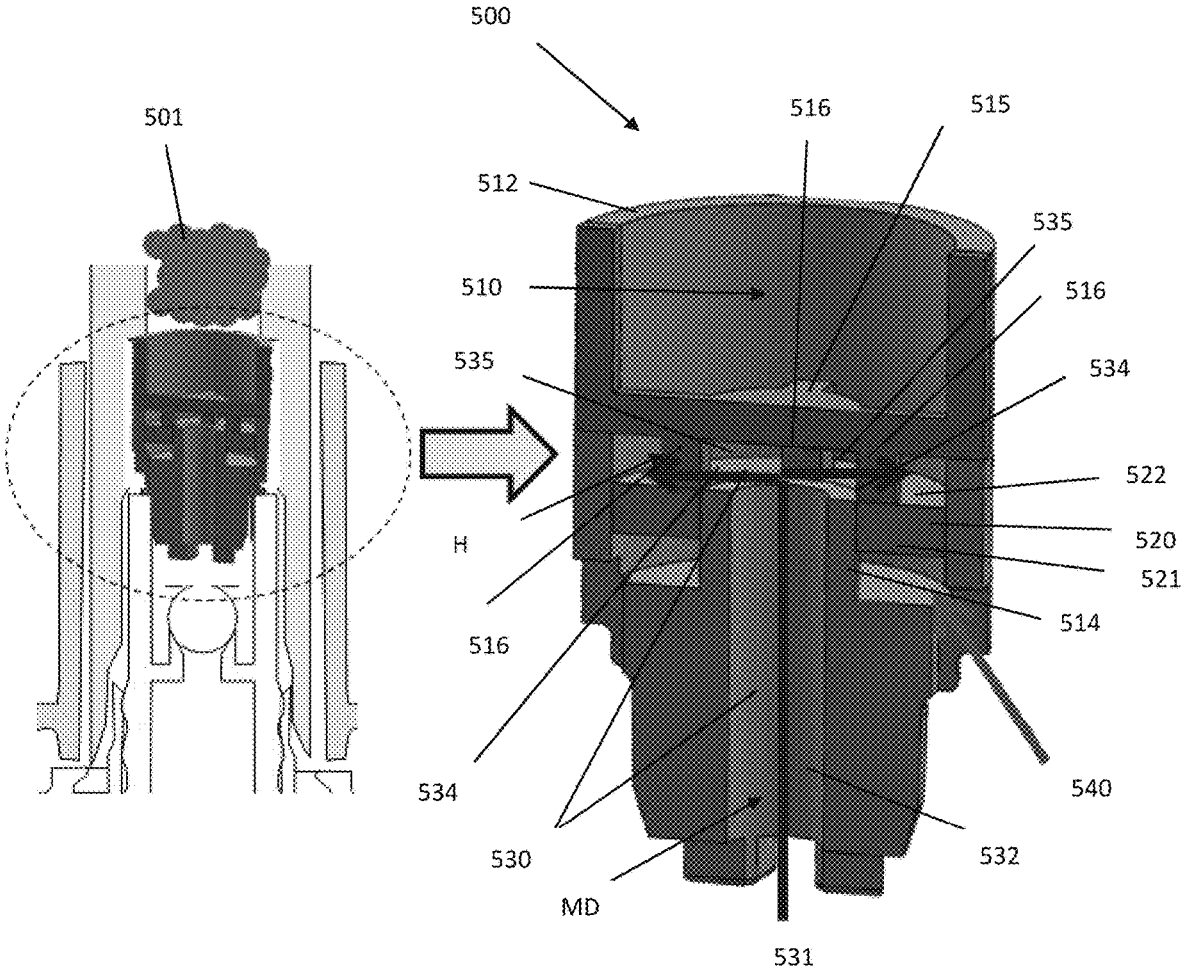
FIG. 5 is a sectional view of yet another foaming dispenser according to one or more embodiments of the disclosed subject matter.

FIG. 5 is a sectional view of yet another foaming dispenser 500 according to one or more embodiments of the disclosed subject matter. Foaming dispenser 500 is similar to foaming dispenser 400 in FIG. 4, with the exception of the configuration of the central projection 514 and brace 515. Thus, foaming dispenser 500 can include a mixing chamber 510, a porous member 520, and a liquid passage 530. The mixing chamber 510 may be formed at least by a mixing chamber body 512 and a surface of the porous member 520 at an output 522 of the porous member 520. Generally, the foaming dispenser 500 may be referred to as an air-through foaming dispenser, meaning that air 540 is passed to an input 521 of the porous member 520, through the porous member 520, and output from the output 522 of the porous member 520 so as to enter the mixing chamber 510. Further, the foaming dispenser 500 can make content liquid 531 foamy by mixing air output from the porous member 520 with the content liquid 531 to create foamy content liquid 501. Though FIG. 5 shows a sectional view, note that the air 540 and the content liquid 531 do not mix until they each reach the mixing chamber 510. Thus, air 540 can be passed to an input 521 of the porous member 520, through the porous member 520, and output from the output 522 of the porous member 520 so as to enter the mixing chamber 510. Further, foaming dispenser 500 can make content liquid 531 foamy by mixing air output from the porous member 520 with the content liquid 531 to create foamy content liquid 501. In that FIG. 5 shows a sectional view, note that the air 540 and the content liquid 531 do not mix until they each reach the mixing chamber 510.

The liquid passage 530 can be comprised of a first liquid passage 532 and a plurality of second liquid passages 534. In particular, FIG. 5 shows a central projection 514 that projects through an opening of the porous member 520, but not necessarily into the mixing chamber 510. Of course, a top surface portion of the central projection 514 may be interpreted as forming part of the mixing chamber 510. Further, the central projection 514 may be hollow and define the first liquid passage 532. The brace 515 may have legs 516, for instance, four or six, that define the second liquid passages 534. In one or more embodiments, the number of second liquid passages 534, which may be defined by the brace 515, can be from two to ten, preferably from four to eight. The porous member 520 can be arranged radially outward of a portion of the first liquid passage 532, for instance, as defined by the central projection 514. The brace 515 may also be configured to retain the porous member 520 in the mixing chamber 510. For example, the brace 515 may prevent the porous member 520 from moving upward (i.e., downstream) in the mixing chamber 510.

FIG. 5 shows two second liquid passages 534, defined between the legs 516 of the brace 515. Of course, since FIG. 5 represents a sectional view, the foaming dispenser 500 can have four second liquid passages 534, for example, each defined between adjacent legs 516 of the brace 515. The second liquid passages 534, as defined between adjacent legs 516, can provide flow of the content liquid 531 into the mixing chamber 510 in at least two directions, for example, four or more directions of flow. Optionally, opposing pairs of second liquid passages 534 can output content liquid 531 in respective opposite directions, in this example, outward, radially outward, for instance. Also, the air 540 can be provided to the mixing chamber 510 at the output 522 of the porous member 520 outward of the openings 535 of the second liquid passages 534. Further, each of the openings 535 can be provided at the output 522 of the porous member 520, for instance, adjacent the output 522 of the porous member 520. In one or more embodiments, optionally, each of the second liquid passages 534 can have a portion (or portions) formed at a right angle with the first liquid passage 532. For example, the height H may be about 0.3 to about 3 mm, preferably about 0.3 to about 2.5 mm. Thus, the height of the openings 535 may be about 0.3 to about 3 mm, preferably about 0.3 to about 2 mm. The height H of the legs 516 may be less than a maximum sectional dimension MD (e.g., diameter) of the first liquid passage 532. For example, the height H may be about 1 mm and the maximum dimension MD may be about 2 mm. Thus, the height of the openings 535 may be about 1 mm. The maximum sectional dimension MD may be about 1.5 mm to about 8 mm, preferably about 2 mm to about 6 mm. The height H2 may be about 0 mm to about 0.3 mm, preferably about 0 mm to about 0.2 mm. The preferable ratio of height H and maximum sectional dimension MD (H/MD) is about 0.1~0.7, more preferably about 0.1~0.5.

Figure 6:
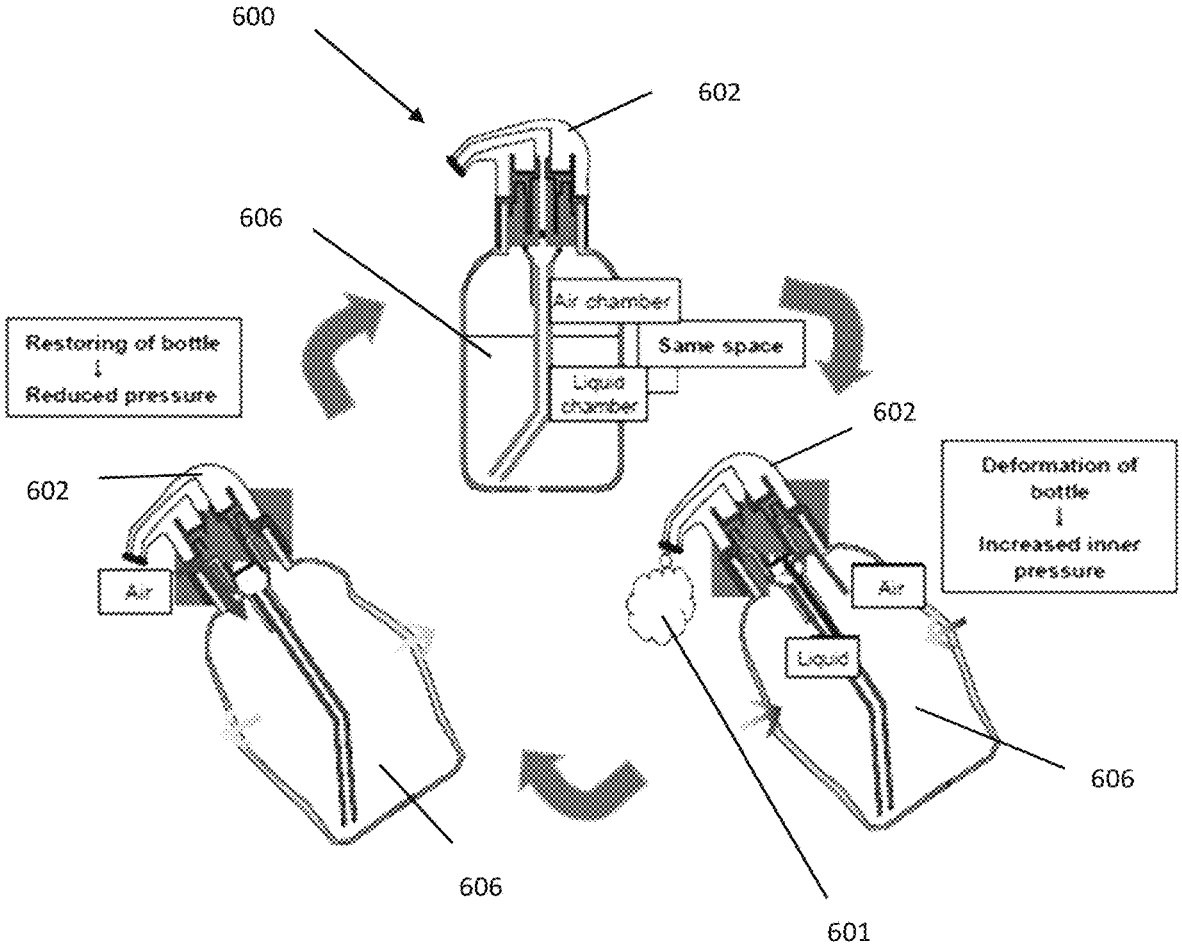
FIG. 6 is an operational diagram of a squeeze foamer assembly according to one or more embodiments of the disclosed subject matter.

FIG. 6 is an operational diagram of a squeeze foamer assembly 600 according to one or more embodiments of the disclosed subject matter. Note, however, that FIG. 6 does not expressly illustrate a foaming dispenser according to embodiments of the disclosed subject being provided therein.

As noted above, a squeeze-type foamer, such as the squeeze foamer assembly 600, can have a shared air and liquid chamber 606 and can operate to discharge foamy content liquid via a squeezing operation to the shared air and liquid chamber. Starting from the top image in FIG. 6, the shared chamber 606 can be subjected to deformation, for example, by a user squeezing the shared chamber 606, which, as illustrated in the right image of FIG. 6, which can increase pressure inside the shared chamber 606 and cause air and content liquid to move from the shared chamber 606 to a mixing chamber via separate flow paths (not expressly identified in FIG. 6), eventually to cause foamy content liquid 601 to exit a cap discharge head 602. Removal of the deformation, i.e., removal of the squeezing force, such as illustrated in the left image of FIG. 6, can reduce pressure inside the shared chamber 606 and cause the shared chamber 606 to expand, based on the drawing of air from outside the squeeze foamer assembly 600 into the shared chamber.

Figure 7A:
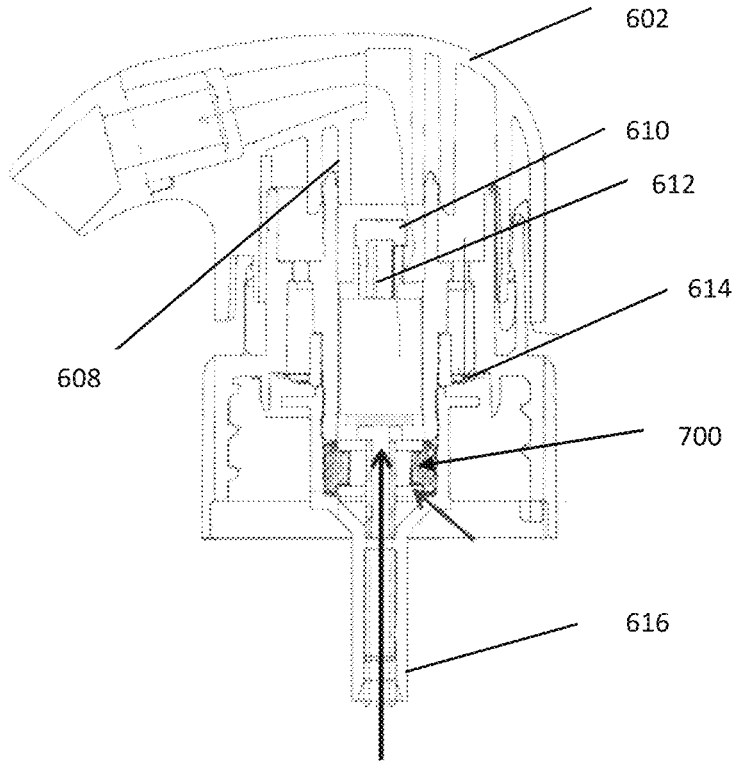
FIG. 7A is a sectional view of a foaming dispenser according to one or more embodiments of the disclosed subject matter.
Figure 7B:
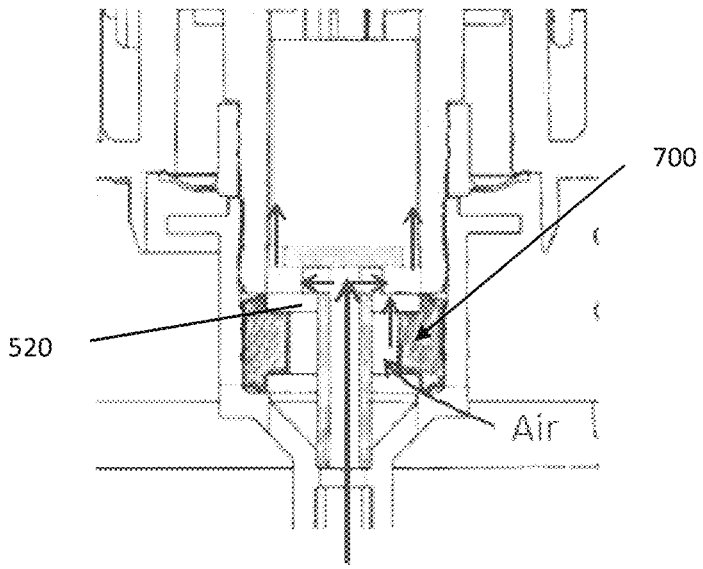
FIG. 7B is an enlarged portion of the foaming dispenser of FIG. 7A.

FIG. 7A is a sectional view of a foaming dispenser 700 according to one or more embodiments of the disclosed subject matter, and FIG. 7B is an enlarged portion of the foaming dispenser 700 of FIG. 7A. The foaming dispenser 700 is shown in FIGS. 7A and 7B as being implemented in a squeeze foamer assembly, which may be the same as or similar to the squeeze foamer assembly 600 of FIG. 6. Hereafter, the squeeze foamer assembly in FIGS. 7A and 7B will be referred to as squeeze foamer assembly 600.

Generally, the squeeze foamer assembly 600 can have a cylinder part 608, a small head 610, a slit or slits 612, a non-return valve 614, and a stem 616. As noted above, the squeeze foamer assembly 600 may also have the cap discharge head 602. Also, the foaming dispenser 700 may also be provided as part of the squeeze foamer assembly 600 (though, of course, the foaming dispenser 700 may also be viewed as a separate component or apparatus). When the cap discharge head 602 is pushed toward the stem 616, the cylinder part 608 can engage the small head 610 and the flow pass can be closed.

The foaming dispenser 700 is similar to or the same as the foaming dispenser 500 in FIG. 5; in this instance, such foaming dispenser 700 is implemented in a different type of foamer, namely, a squeeze-type foamer such as described herein. Of course, embodiments of the disclosed subject matter are not limited implementing foaming dispenser 500/700 in squeeze-type foamer, and may implement another foaming dispenser according to embodiments of the disclosed subject matter, such as those illustrated with respect to FIGS. 2A, 2B, 3, 4, and 5.

Embodiments of the disclosed subject matter may also be as set forth according to the parentheticals in the following paragraphs.

(1) A foaming dispenser for making content liquid discharge foamy by mixing air flow from an air chamber with content liquid flow from a liquid chamber, comprising: a mixing chamber configured to mix air and content liquid; a porous member between an air passage from the air chamber and the mixing chamber; and a liquid passage from the liquid chamber to the mixing chamber, the liquid passage having a first liquid passage and a plurality of second liquid passages, the liquid passage being configured such that content liquid flows from the first liquid passage to the second liquid passages to the mixing chamber, wherein the second liquid passages are configured to provide flow of the content liquid in at least two directions.

(2) The foaming dispenser according to (1), further comprising: the air chamber; and the liquid chamber, wherein the air chamber and liquid chamber are different chambers.

(3) The foaming dispenser according to (1) or (2), wherein the foaming dispenser is a mechanical pump foaming dispenser configured to discharge the foamy content liquid via operation of a mechanical pump.

(4) The foaming dispenser according to (1) or (3), further comprising: the air chamber; and the liquid chamber, wherein the air chamber and liquid chamber are a same chamber.

(5) The foaming dispenser according to any one of (1), (3) or (4), wherein the foaming dispenser is a squeezable foaming dispenser configured to discharge the foamy content liquid via a squeezing operation to a same chamber holding the content liquid and air.

(6) The foaming dispenser according to any one of (1) to (5), wherein the first liquid passage intersects the second liquid passages.

(7) The foaming dispenser according to any one of (1) to (6), wherein an end portion of the first liquid passage is adjacent to a first end portion of each of the second liquid passages, and wherein a second end portion of each of the second liquid passages opposite the first end portion is in direction fluid communication with the mixing chamber.

(8) The foaming dispenser according to any one of (1) to (7), wherein a sectional area orthogonal to each of the second liquid passages is smaller than a sectional area orthogonal to the first liquid passage.

(9) The foaming dispenser according to any one of (1) to (8), wherein a total sectional area of all of the second liquid passages is less than a total sectional area orthogonal to the first liquid passage.

(10) The foaming dispenser according to any one of (1) to (9), wherein each of the second liquid passages has a portion at a right angle with the first liquid passage.

(11) The foaming dispenser according to any one of (1) to (10), wherein a total surface area of a surface of the porous member at an output side of the porous member is greater than a total sectional area of respective openings to the mixing chamber of the second liquid passages.

(12) The foaming dispenser according to any one of (1) to (11), wherein an opening communicating from each of the second passages to the mixing chamber is formed at an output side of the porous member.

(13) The foaming dispenser according to any one of (1) to (12), wherein end portions of the second liquid passages open to the mixing chamber adjacent to an output side of the porous member.

(14) The foaming dispenser according to any one of (1) to (13), wherein the content liquid and the air flow first enter or are first provided to the mixing chamber at a same time.

(15) The foaming dispenser according to any one of (1) to (14), wherein the air from the air chamber and the content liquid from the liquid chamber first come into contact with each other in the mixing chamber.

(16) The foaming dispenser according to any one of (1) to (15), wherein the mixing chamber is defined by at least a mixing chamber body and a surface of the porous member at an output side output side of the porous member.

(17) The foaming dispenser according to any one of (1) to (16), wherein the air is output from the porous member so as to intersect the content liquid output from the second liquid passages to the mixing chamber.

(18) The foaming dispenser according to any one of (1) to (17), wherein a first direction at which air is provided from the porous member to the mixing chamber intersects a second direction at which the content liquid is output from each of the second liquid passages to the mixing chamber.

(19) The foaming dispenser according to any one of (1) to (18), wherein flow of the foamy content liquid passes from the mixing chamber to a discharge opening goes to vertically, and then horizontally to reach the discharge opening.

(20) The foaming dispenser according to any one of (1) to (19), wherein the liquid passage reaches the mixing chamber without going through the porous member.

(21) The foaming dispenser according to any one of (1) to (20), wherein the content liquid flow bypasses the porous member.

(22) The foaming dispenser according to any one of (1) to (21), wherein the content liquid is output radially inward from the second liquid passages into the mixing chamber.

(23) The foaming dispenser according to any one of (1) to (22), wherein the content liquid is output radially inward from the second liquid passages into the mixing chamber, and wherein the air is provided to the mixing chamber at an output side of the porous member radially inward of respective openings of the second liquid passages into the mixing chamber.

(24) The foaming dispenser according to any one of (1) to (23), wherein the porous member is arranged above the first liquid passage and below the mixing chamber.

(25) The foaming dispenser according to any one of (1) to (21), wherein the content liquid is output radially outward from the second liquid passages into the mixing chamber.

(26) The foaming dispenser according to any one of (1) to (21) or (25), wherein the content liquid is output radially outward from the second liquid passages into the mixing chamber, and wherein the air is provided to the mixing chamber at an output side of the porous member radially outward of respective openings of the second liquid passages into the mixing chamber.

(27) The foaming dispenser according to any one of (1) to (21), (25), or (26), wherein the porous member is arranged radially outward of a portion of the first liquid passage.

(28) The foaming dispenser according to any one of (1) to (27), wherein the content liquid includes one or more of powder, particles, or abrasives.

(29) The foaming dispenser according to any one of (1) to (28), wherein particle size of one, some, or all of the powder, particles, or abrasives is from about 0.1 μm to about 700 μm.

(30) The foaming dispenser according to any one of (1) to (29), wherein the one or more of powder, particles, or abrasives are provided to the content liquid before reaching the mixing chamber.

(31) The foaming dispenser according to any one of (1) to (30), wherein a viscosity of the content liquid is from about 10 centipoise to about 20000 centipoise.

(32) The foaming dispenser according to any one of (1) to (31), wherein the blend ratio of the air and the liquid (air/liquid) by volume ratio is about 10~40.

(33) The foaming dispenser according to any one of (1) to (32), wherein the porous member is in the form of a flat plate, a flat ring, or a flat disc.

(34) The foaming dispenser according to any one of (1) to (33), wherein the porous member is configured to allow air to pass and to prevent the content liquid from passing.

(35) The foaming dispenser according to any one of (1) to (34), wherein the porous member has an average pore size of from about 20 μm to about 100 μm.

(36) The foaming dispenser according to any one of (1) to (35), wherein the porous member is formed of a porous material including mesh, gauze, foam, sponge or a combination of two or more of mesh, gauze, foam, or sponge.

(37) The foaming dispenser according to any one of (1) to (36), wherein the porous member is fixedly provided relative to the mixing chamber.

(38) The foaming dispenser according to any one of (1) to (37), wherein the porous member is held in place by a brace that defines the second liquid passages.

(39) The foaming dispenser according to any one of (1) to (38), further comprising an air compression transport means that moves the air from the air chamber to the mixing chamber.

(40) The foaming dispenser according to any one of (1) to (39), further comprising a liquid compression transport means which moves the content liquid from liquid chamber to pass the second liquid passages through pass the first liquid passage to the mixing chamber.

(41) The foaming dispenser according to any one of (1) to (40), wherein the air compression transport means includes a piston of the air chamber which changes the capacity of the air chamber, and the liquid compression transport means includes a piston of the liquid chamber which changes the capacity of the liquid chamber, wherein the foaming dispenser further comprises a pressing part, and wherein the piston of the air chamber and the piston of the liquid chamber are slide in the air chamber and the liquid chamber by pushing the pressing part by hand.

(42) The foaming dispenser according to any one of (1) to (41), further comprising a container body configured to hold at least the content liquid.

(43) The foaming dispenser according to any one of (1) to (42), wherein the plurality of second liquid passages consist of four second liquid passages or comprise at least four second liquid passages.

(44) The foaming dispenser according to any one of (1) to (43), wherein the plurality of second liquid passages include at least one pair of second liquid passages that output content liquid in opposite directions.

(45) The foaming dispenser according to any one of (1) to (44), further comprising a fixing member configured to retain the porous member, wherein the fixing member is provided at the output side of the porous member.

(46) The foaming dispenser according to any one of (1) to (45), further comprising a fixing member configured to retain the porous member, wherein the fixing member has concave portions that form part of the plurality of second liquid passages.

(47) The foaming dispenser according to any one of (1) to (46), further comprising a fixing member configured to fix the porous member, wherein the fixing member is provided in the mixing chamber.

(48) The foaming dispenser according to any one of (1) to (47), wherein the porous member is arranged between the first liquid passage and respective outputs of the plurality of second liquid passages, and below the mixing chamber.

(49) A foamer assembly comprising: a container body configured to hold at least the content liquid; and the foaming dispenser according to any one of (1) to (48), wherein the foaming dispenser is mounted to a neck of the container body.

(50) A dispenser to make content liquid foamy comprising: means making the content liquid foamy by mixing air and content liquid; means for allowing the air to pass to the means for mixing; and means for providing the content liquid to the means for mixing.

(51) A method of providing, making, or using a foaming dispenser according to any one of (1) to (48).

(52) A method of providing, making, or using a foamer assembly according to (49).

(53) A method of providing, making, or using a dispenser according to (50).

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed. Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features. Accordingly, Applicant intends to embrace all such alternatives, modifications, equivalents, and variations that are within the spirit and scope of the present disclosure.

The invention claimed is:

1. A foaming dispenser for making content liquid discharge foamy by mixing air flow from an air chamber with content liquid flow from a liquid chamber, comprising:

a mixing chamber configured to mix air and content liquid;

a porous member between an air passage from the air chamber and the mixing chamber;

a liquid passage from the liquid chamber to the mixing chamber, the liquid passage having a first liquid passage and a plurality of second liquid passages, the liquid passage being configured such that content liquid flows from the first liquid passage to the second liquid passages to the mixing chamber; and a flow path, from the porous member to an opening of a cap discharge head where the foamy content liquid is discharged from the foaming dispenser, including a vertical flow and a horizontal flow, the vertical flow being parallel to a stem which extends into the liquid chamber and forms a part of the liquid passage, and the vertical flow having a length that is equal to or greater than the horizontal flow, wherein the second liquid passages are configured to provide flow of the content liquid in at least two directions, and the second liquid passages are contiguous with the first liquid passage.

2. The foaming dispenser according to claim 1, wherein the plurality of second liquid passages comprise at least four second liquid passages.

3. The foaming dispenser according to claim 1, wherein the plurality of second liquid passages include at least one pair of second liquid passages that output content liquid in opposite directions.

4. The foaming dispenser according to claim 1, wherein the first liquid passage intersects the second liquid passages.

5. The foaming dispenser according to claim 1, wherein a total sectional area of all of the second liquid passages is less than a total sectional area orthogonal to the first liquid passage.

6. The foaming dispenser according to claim 1, wherein a total surface area of a surface of the porous member at an output side of the porous member is greater than a total sectional area of respective openings to the mixing chamber of the second liquid passages.

7. The foaming dispenser according to claim 1, wherein an opening communicating from each of the second liquid passages to the mixing chamber is formed at an output side of the porous member.

8. The foaming dispenser according to claim 1, wherein the foaming dispenser is structured such that the content liquid and the air flow first enter or are first provided to the mixing chamber at a same time.

9. The foaming dispenser according to claim 1, wherein the mixing chamber is defined by at least a mixing chamber body and a surface of the porous member at an output side of the porous member.

10. The foaming dispenser according to claim 1, wherein the content liquid is output radially inward from the second liquid passages into the mixing chamber in a direction that is perpendicular to a direction in which the stem extends and towards a same point on the direction in which the stem extends.

11. The foaming dispenser according to claim 1, wherein the content liquid is output radially outward from the second liquid passages into the mixing chamber.

12. The foaming dispenser according to claim 1, wherein the porous member is arranged between the first liquid passage and respective outputs of the plurality of second liquid passages, and below the mixing chamber.

13. The foaming dispenser according to claim 1, wherein the content liquid includes one or more of powder, particles, or abrasives, and the foaming dispenser makes the content liquid including the one or more of powder, particles, or abrasives foamy.

14. The foaming dispenser according to claim 1, wherein a blend ratio of the air and the liquid mixed by the mixing chamber is about 10~40 by volume ratio.

15. The foaming dispenser according to claim 1, further comprising a fixing member configured to retain the porous member, wherein the fixing member is provided at an output side of the porous member.

16. The foaming dispenser according to claim 1, further comprising:

the air chamber; and the liquid chamber, wherein the air chamber and liquid chamber are different chambers.

17. The foaming dispenser according to claim 1, wherein the foaming dispenser is a mechanical pump foaming dispenser configured to discharge the foamy content liquid via operation of a mechanical pump.

18. The foaming dispenser according to claim 1, wherein the foaming dispenser is a squeezable foaming dispenser configured to discharge the foamy content liquid via a squeezing operation to a same chamber holding the content liquid and air.

19. The foaming dispenser according to claim 1, further comprising a container body configured to hold at least the content liquid.

20. The foaming dispenser according to claim 1, further comprising a fixing member configured to fix the porous member, wherein the fixing member is provided in the mixing chamber.

* * * * *